United States Patent [19]

Stunzi et al.

[11] Patent Number: 4,808,963

[45] Date of Patent: Feb. 28, 1989

[54] REPLACEABLE HIGH CURRENT DRAW OUT FUSEHOLDER

[75] Inventors: Joseph M. Stunzi, Athens; James R. Sellers, Watkinsville, both of Ga.

[73] Assignee: Westinghouse Electric Corp., Pittsburgh, Pa.

[21] Appl. No.: 137,707

[22] Filed: Dec. 24, 1987

[51] Int. Cl.[4] ..... H01H 85/14; H01H 85/02

[52] U.S. Cl. ..... 337/246; 337/186; 337/204

[58] Field of Search ..... 337/246, 248, 251, 252, 337/158, 186, 204, 227, 228

[56] References Cited

U.S. PATENT DOCUMENTS

| | | | |
|---|---|---|---|
| 3,184,829 | 5/1965 | Shobert | 29/155.5 |
| 3,828,000 | 7/1974 | Luck et al. | 260/37 |
| 3,911,385 | 10/1975 | Blewitt et al. | 337/202 |
| 3,979,709 | 9/1976 | Healey, Jr. | 337/186 |
| 4,102,851 | 7/1978 | Luck et al. | 260/37 |
| 4,320,375 | 3/1982 | Lien | 337/204 |
| 4,625,196 | 11/1986 | Muench et al. | 337/204 |
| 4,628,292 | 12/1986 | Muench et al. | 337/204 |

FOREIGN PATENT DOCUMENTS 704315 2/1965 Canada .

*Primary Examiner*—H. Broome
*Attorney, Agent, or Firm*—Daniel P. Cillo

[57] ABSTRACT

A drawout fuseholder 10 is made, containing two electrically conductive contacts 11 and 12 and having an insulating tube 13 connected thereto and disposed therebetween, where the tube tube has a smooth, hard inner surface 15 and outer surface 16 of glass free cycloaliphatic epoxy resin and a central glass fiber member 14 impregnated with cycloaliphatic epoxy resin, where a metallic fuse element is connected to the contacts through the interior of the tube.

8 Claims, 1 Drawing Sheet

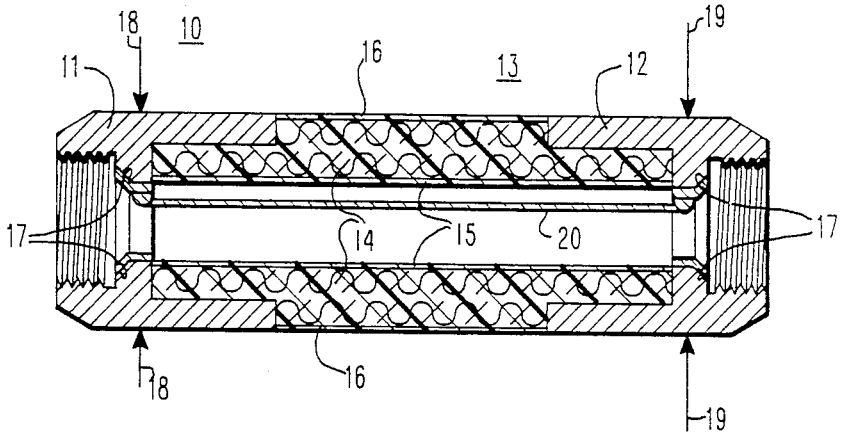
18
10
19
11
16
13
12
17
14
15
20
17
18
16
19

REPLACEABLE HIGH CURRENT DRAW OUT FUSEHOLDER

BACKGROUND OF THE INVENTION

This invention relates to a replaceable, high current, draw-out fuseholder, having a unitary, cycloaliphatic, epoxy-glass, filament wound, tubular insulating member with resin rich surfaces disposed between fuse contacts. These fuseholders are used in pad mounted and submersible distribution transformers.

Replaceable, under oil expulsion fuses are generally used in high voltage systems to protect electric devices from fault currents, and are disclosed in U.S. Pat. No. 4,320,375 (Lien). There, the fuseholder includes a glass wound tube, impregnated with epoxy resin, covering an inner pressure tube of a nontracking, nonconducting material, such as polytetrafluoroethylene (Teflon). Both tubes are shown having about the same thickness. Hoop strengths of about 141 kg./cm$^2$ (2000 psi) are mentioned. This composite, tubular, insulating structure is disposed between and fitted flush with two electrically conductive contacts having similar lengths and configurations. A metallic fuse element which will melt at a particular load current or temperature, to interrupt the circuit, extends through the interior of the hollow tubular structure between the contacts. The fuseholder is shown mounted in an open housing which is totally immersed in insulating oil. This type of fuseholder has disadvantages of relatively low hoop strength, and an outer surface containing exposed glass filaments which may cause copper tracking from mating housing contacts, during insertion or removal of the fuseholder, limiting its replaceability.

Similar type expulsion fuses, having a glass epoxy-Teflon pressure tube between threadedly mounted metal contacts of similar length and configuration, each having a diameter substantially greater than the pressure tube, are disclosed in U.S. Pat. No. 4,625,196 (Muench et al.) In this patent, primarily directed to the fuse assembly, both metal contacts have a beveled inner chamfer so that the pressure tube substantially "blends" into the contacts. In a modification of this design, U.S. Pat. No. 4,628,292 (Muench et al.) discloses a single layer, glass epoxy pressure tube between threadably mounted metal contacts, each having a diameter substantially greater than the pressure tube. In this patent, also primarily directed to the fuse assembly, one metal contact has a beveled inner chamfer and the other metal contact, which appears elongated, has a sharp inner edge, and contains both an inner pressure chamber and vent holes through the contact surface to the pressure chamber.

Earlier art had disclosed the use of epoxy resin impregnated glass fibers as tubular structures for a variety of fuse types. Canadian Pat. No. 704,315 (Cannady et al.) discloses such tubes, with encircling band members of epoxy resin impregnated material, such as cotton, nylon or Dacron, that could be easily machined to provide end threads. U.S. Pat. No. 3,184,829 (Shobert) discloses a compressed boric acid inner tube and a ground smooth outer tube of resin impregnated glass fiber braiding.

U.S. Pat. No. 3,911,385 (Blewitt et al.) discloses an outdoor, weather resistant fuse, which uses a melamine resin impregnated glass fiber tube, coated on its outer surface with a cycloaliphatic epoxy resin. The epoxy resin contains a flexibilizing agent, such as a mixture of polyazelaic polyanhydride and hexahydrophthalic anhydride, filler such as aluminum trihydrate or naturally occurring magnesite, and asbestos thickener-thixotroping agent. The outer coating is from 0.007 cm. (0.003 inch) to 0.051 cm. (0.020 inch) thick. A silicone rubber sealant is used in the joint between the tubular member and end terminals of similar length and configuration. No separate inner tubular member or coating is used, so melamine resin and glass fibers are exposed to the contaminating products of fuse link melt down. Problems associated with this design are possible carbonization of the glass fibers in the tube interior, and bonding of the epoxy resin and melamine resin at the coating interface. U.S. Pat. No. 3,979,709 (Healey, Jr.) discloses a fuse having a central tube made of thermoset resin impregnated glass fiber mat, having non-uniformly oriented fibers disposed between inner and outer tubular members made of thermoset resin impregnated glass fiber fabric.

In another area, feed tubes, used in extra high voltage circuit breakers, operating in an environment of $SF_6$ gas subject to arcing, have been made using resin rich, flexible, cycloaliphatic epoxy resin surfaces. U.S. Pat. Nos. 3,828,000 and 4,102,851 (both Luck et al.) disclose mixtures of cycloaliphatic epoxy resin containing polyazelaic polyanhydride or hexahydrophthalic anhydride as a flexibilizer and curing agent, aluminum trihydrate, and either aluminum oxide $Al_2O_3$ or short-fiber asbestos as an essential thixotropic agent. This mixture is disclosed as being coated on mandrels, cured, covered with filament wound glass fibers coated with the same mixture, recoated on top also with the same mixture, and finally cured to provide a flexible insulating surface.

Most such previously described structures have not been found to provide superior hoop strength, to withstand the high pressure shock wave created by the vaporization of the fuse element, and at the same time eliminate any cracks between various component layers, to provide superior dielectric properties when exposed to hot oil conditions, and to eliminate copper tracking of the outer surface upon removal or insertion against mating contacts; so that the fuseholder is highly replaceable. It is the object of this invention to solve such problems.

SUMMARY OF THE INVENTION

Accordingly, the invention resides in a replaceable, high current fuseholder, for use in an oil-immersed draw-out expulsion device, for protecting the distribution system in pad mounted or submersible transformers, characterized in that said fuseholder comprises two electrically conductive contacts having a unitary insulating tube connected thereto and disposed therebetween, the tube containing a cycloaliphatic epoxy resin impregnated glass fiber member having a glass free, smooth, hard, cycloaliphatic epoxy resin inner surface which extends beneath a portion of each contact, and a glass free, smooth, hard, cycloaliphatic epoxy resin outer surface, with a metallic fuse element connected to the contacts through the interior of the tube.

The resin used is a cycloaliphatic epoxy resin, preferably containing an anhydride curing agent and aluminum trihydrate filler. The cycloaliphatic epoxy resin inner surface is from 0.025 cm. (0.01 inch) to 0.076 cm. (0.03 inch) thick. The cycloaliphatic epoxy resin impregnated glass fiber member is filament wound. The cycloaliphatic epoxy resin outer surface is from 0.013 cm. (0.005 inch) to 0.102 cm. (0.04 inch) thick, and must be smooth and hard so that copper housing contacts will not be abraded as they slide along its surface. Hoop strength of this fuseholder is from 2,115 kg./cm$^2$ (30,000 psi) to 3,525 kg./cm$^2$ (50,000 psi), with essentially no interior tracking, and with minimal exterior copper contact abrading or tracking, making the fuseholder reusable from 5 to 10 times. These fuseholders also have very high current ratings.

BRIEF DESCRIPTION OF THE DRAWING

In order that the invention can be more clearly understood, convenient embodiments thereof will now be described, by way of example, with reference to the accompanying drawing which is a cross-sectional view of the replaceable, high current, draw out fuseholder of this invention.

DESCRIPTION OF THE PREFERRED EMBODIMENTS

Referring now to the figure, a fuseholder 10 is shown, having a first electronically conductive contact 11 and a second electronically conductive contact 12, with a unitary insulating tube 13 disposed between the contacts. The insulating tube can be held in place by steel pins (not shown), which pass through each contact and into an underlying portion of the insulating tube. The insulating tube 13 comprises a cycloaliphatic epoxy resin impregnated glass fiber member 14, having a glass free, smooth, tough, rigid, cycloaliphatic epoxy resin inner surface 15, and a glass free, smooth, tough, rigid cycloaliphatic epoxy resin of surface 16. Thus, the tubular member 14 has resin inner and outer coatings. As can be seen, the resin rich coatings are thin as compared to the resin impregnated fiber glass body, and so, the tube is of essentially unitary construction. Both surfaces 15 and 16 are essential, however, in providing the improved characteristics of the fuseholder 10. As can be seen, a portion of the tube 13, most importantly inner surface 15, extends underneath a certain selected portion of each contact 11 and 12. Thus the top surface of the contacts rests on an inner portion of the tube. This is essential in providing good arc extinguishing characteristics to the interior of the fuseholder.

Resins useful in this invention as an impregnant in the tubular member 14, and as surfaces 15 and 16, are cycloaliphatic epoxy resins. These resins are thermo resins and have excellent toughness, corrosion and chemical resistance, and excellent dielectric properties. These cycloaliphatic epoxy resins are generally prepared by epoxidizing unsaturated aromatic hydrocarbon compounds, such as cyclo-olefins, using hydrogen peroxide or peracids such as peracetic acid and perbenzoic acid. The organic peracids are generally prepared by reacting hydrogen peroxide with either carboxylic acids, acid chlorides or ketones to give the compound R—COOOH. These resins are commercially available and well known in the art, and reference may be made to Brydson, J., *Plastic Materials*, 1966, p. 471, for their synthesis and detailed description. Examples of these cycloaliphatic epoxides would include 3,4-epoxycyclohexylmethyl-3,4-epoxy-cyclohexane carboxylate; vinyl cyclohexene dioxide; 3,4-epoxy-6-methylcyclohexylmethyl-3,4-epoxy-6-methylcyclohexane carboxylate; and dicyclopentadiene.

The resin will also contain effective amounts of a curing agent such as an acid anhydride, for example, hexahydrophthalic anhydride, pyromellitic dianhydride, and the like, or a Lewis Acid, for example, boron trifluoride, and the like, with anhydrides being preferred. The term "cycloaliphatic epoxy resin" as used herein will mean such resin including a curing agent. Preferably, the cycloaliphatic epoxy resin will contain inorganic fillers that are effective to impart noncombustible properties to the resin, such as naturally occurring magnesite ($MgCO_3$), and most preferably, alumina trihydrate ($Al_2O_3$19 $3H_2O$), which has arc quenching capability. These fillers can be added in amounts up to about 50% by weight of the resin-curing agent weight. These fillers can be used in the glass fiber member 14 and both the surfaces 15 and 16. Preferably, both surfaces will have these filler particles. The resin can also contain other materials such as ultraviolet radiation curable curing agents, coloring pigments, and lubricants. The composition of the resin should be such as to provide tough outer surfaces 15 and 16.

The insulating tube 13 can be made by first applying a coating of cycloaliphatic epoxy resin on a lubricated mandrel, such as by a spraying technique, to form a thin tubular layer. This layer is then cured to solidify the resin, so that during subsequent filament winding, filaments will not penetrate the layer. The preferred thickness of this layer is from 0.025 cm (0.01 inch) to 0.076 cm (0.03 inch).

The fuse holder 10 is of the "bay-o-net" type, where a short, intense, gas blast arises from rapid decomposition of a small cross-section of the inner wall of the tube under the heat of the arc formed when the metallic fuse element 20 melts to break the circuit. The fuse element is connected to fuse contacts 11 and 12 through the interior of the tube 13. The fuse element is usually contained in a tubular polytetrafluoroethylene (Teflon) container (not shown) of smaller diameter than the inner diameter of the tube 13. The fuse element 20 has end portions that mate to the fuseholder contacts 11 and 12 at flange points 17.

This Teflon container will completely decompose during circuit breaking operation, causing additional pressure and releasing decomposition materials, which will contact the inner epoxy resin surface 15. Transformer oil in submergible fuseholders will also be in contact with the inner resin surface 15, and hot oil contamination products formed by the arc will also contact the inner resin surface 15. The resin surface 15 must be of cycloaliphatic epoxy resin, which is highly resistant to heat and hot contamination products, and must be of a thickness over 0.025 cm (0.01 inch) in order to resist high generated pressures caused by arcing and allow reuse even though small cross-sections are vaporized after each circuit breaking action of the fuseholder. This resin cannot be substituted for by melamine resins which require solvents that could become trapped in the thick filament winding upon cure, or bisphenol A type epoxy resins, which lack the physical and electrical properties of the cycloaliphatics.

The cured inner resin coating 15 is next covered with a thick filament wound layer of cycloaliphatic epoxy resin coated glass fibers, to a thickness of from approximately 0.38 cm (0.15 inch) to 0.76 cm (0.3 inch). This layer is then also cured. This winding has criss-crossed layer, as is well known in the art, which provide outstanding hoop strength. Since the cross-sectional thickness of this filament wound glass fiber tubular member 14 is from approximately 68% to 98% of the cross-sectional thickness of the tube wall, a strong, unitary wall is formed which can resist pressures of at least 2,115 kg./cm$^2$ (30,000 psi). It is essential that the coatings on the inner and outer walls of the cycloaliphatic epoxy resin-glass fiber member 14 be no more than about 32% of the total thickness of the tube 13, to insure the integrity of the fuseholder in high current applications.

After curing the resin-glass fiber portion of the tube, the outer cycloaliphatic epoxy resin-glass fiber surface can be ground to assure proper symmetry about the axial center point. Then the outer coating 16 can be applied. This outer cycloaliphatic epoxy resin coating can be electrostatically sprayed as a fine powder onto the surface of the resin-glass fiber member 14 to provide a coating preferably from 0.013 cm (0.005 inch) to 0.102 cm (0.04 inch) thick.

The fuseholder 10 is of a replaceable type and is part of an oil-immersed draw-out expulsion device, generally including a housing, used with an electrical distribution apparatus, as is well known in the art. Such an expulsion device, without a housing, is shown in U.S. Pat. Nos. 4,625,196 and 4,628,292. The housing incorporates pressure loaded, usually spring loaded housing contacts (not shown in the figure), which touch the fuse contacts 11 and 12 at points 18 and 19 shown by arrows, when the fuseholder is in an inserted, at-rest position.

During the fuseholder insertion, fuse contact 12, which, for purposes of illustration will be considered the insertion end, would be slid past the pressure loaded housing contacts at point 18, after which the top surface of the tube, layer 16, would also be slid past housing contacts at point 18 until reaching a rest point, as shown. Upon withdrawal, housing contacts at point 18 would again have potential to abrade or be abraded by the top layer 16 as the fuse holder is drawn across them. These housing contacts are usually made of copper, and can leave copper tracks across the top surface 16 during fuseholder insertion and removal. These copper tracks can be minimized if the top surface 16 is of a smooth, hard resin with no glass fiber present to scrape the copper housing contacts, as in this invention. Thus, the simple, inexpensive, flush fitting design shown in the drawing can be used without fear of copper tracking. It is essential that the top resin surface be at least 0.013 cm (0.005 inch) thick to accomplish this result. This would also be thick enough that any frictional scrapes caused by the housing contacts would not penetrate to the glass fiber portion of the tube.

The invention will now be illustrated with reference to the following Example:

EXAMPLE

A fuseholder was constructed with two brass contacts connected by an insulating tube. The contacts were held in place by steel pins through each contact and into the tube portion beneath the contact top surface. The insulating tube was constructed of an outer, glass free resin surface about 0.025 cm (0.01 inch) thick, an inner, glass free resin surface about 0.025 cm (0.01 inch) thick, and a central glass fiber filament wound resin impregnated member about 0.5 cm (0.2 inch) thick. Thus the glass fiber portion constituted 91% of the tube wall.

The tube was of unitary construction and both surfaces were smooth and hard. The resin used in all cases was an anhydride cured cycloaliphatic epoxy resin, containing alumina trihydrate filler particles. For comparison, another fuseholder (Sample 2) was constructed in the same fashion, but the inner surface of the tube was made from polytetrafluoroethylene (Teflon), the central filament wound member constituted only about 35% of the tube wall thickness, and no top coating was applied to the filament wound member. Tests were run on the two fuseholders and the results are shown below in Table 1.

TABLE 1

| Sample | Inner Wall Surface | Outer Wall Surface | % Wall Thickness Center Glass Portion | Hoop Strength at Failure | Inclined Plane Test Tracking Time* For 2" or Less Track |
|---|---|---|---|---|---|
| 1 | Cycloaliphatic Epoxy | | 91% | 30,000 psi | 600 min. I. Dia<br>70 min. O. Dia. |
| **2 | Teflon | Epoxy-Glass | 35% | 250 psi | 20 min. I. Dia.<br>10 min. O. Dia. |

*ASTM D2303
**Comparative Sample

As can be seen, a dramatic increase in hoop strength resulted from the design of this invention as well as good improvements in tracking. Additionally, when a fuseholder was inserted into a sample housing with spring loaded copper housing contacts, Sample 1 did not abrade the copper after several insertions.

We claim:

1. A fuseholder comprising two electrically conductive contacts having an insulating tube connected thereto and disposed therebetween, the tube containing a cycloaliphatic epoxy resin impregnated glass fiber member having a glass free, smooth, hard, cycloaliphatic epoxy resin inner surface resistant to electrical arcing, and a glass free, smooth, hard, cycloaliphatic epoxy resin outer surface resistant to abrading contacting metallic components in use, where a metallic fuse element is connected to the contacts through the interior of the tube.

2. The fuseholder of claim 1, where the glass fiber member is a filament wound glass fiber member.

3. The fuseholder of claim 1, where the inner surface is from 0.025 cm. to 0.076 cm. thick, and the outer surface is from 0.013 cm. to 0.102 cm. thick.

4. The fuseholder of claim 1, where the cross-sectional thickness of the glass fiber member is from 68% to 98% of the cross-sectional thickness of the tube.

5. A replaceable, high current fuseholder for use in a transformer draw out expulsion device, comprising two electrically conductive contacts having an insulating tube connected thereto and disposed therebetween, with a metallic fuse element connected to the contacts through the interior of the tube, the improvement characterized in that the tube contains a cycloaliphatic epoxy resin impregnated glass fiber member having a glass free, smooth, hard, cycloaliphatic epoxy resin inner surface resistant to electrical arcing, which extends underneath a portion of each contact, and a glass free, smooth, hard, cycloaliphatic epoxy resin outer surface resistant to abrading contacting metallic components in use.

6. The fuseholder of claim 4, where the glass fiber member is a filament wound glass fiber member.

7. The fuseholder of claim 4, where the inner surface is from 0.025 cm. to 0.076 cm. thick, and the outer surface is from 0.013 cm. to 0.102 cm. thick.

8. The fuseholder of claim 4, where the cross-sectional thickness of the glass fiber member is from 68% to 98% of the cross-sectional thickness of the tube wall.

* * * * *